US009062693B2

(12) United States Patent
Engels et al.

(10) Patent No.: US 9,062,693 B2
(45) Date of Patent: Jun. 23, 2015

(54) FLUID OPERATED ACTUATOR

(75) Inventors: Martin Engels, Alpen (DE); Roland Verhulsdonk, Rheinberg (DE); Ralph Reidel, Rheinberg (DE)

(73) Assignee: Norgren GmbH, Alpen (DE)

( * ) Notice: Subject to any disclaimer, the term of this patent is extended or adjusted under 35 U.S.C. 154(b) by 532 days.

(21) Appl. No.: 13/501,131

(22) PCT Filed: Oct. 29, 2010

(86) PCT No.: PCT/EP2010/006614

§ 371 (c)(1),
(2), (4) Date: Apr. 10, 2012

(87) PCT Pub. No.: WO2011/050969

PCT Pub. Date: May 5, 2011

(65) Prior Publication Data

US 2012/0198991 A1 Aug. 9, 2012

Related U.S. Application Data

(60) Provisional application No. 61/256,176, filed on Oct. 29, 2009.

(51) Int. Cl.
*F15B 15/20* (2006.01)
*F15B 15/14* (2006.01)

(52) U.S. Cl.
CPC ..... *F15B 15/202* (2013.01); *F15B 15/1442* (2013.01); *F15B 15/1438* (2013.01)

(58) Field of Classification Search
CPC . F15B 15/1438; F15B 15/1442; F15B 15/202
USPC ..... 91/358 R, 459; 92/163, 168
See application file for complete search history.

(56) References Cited

U.S. PATENT DOCUMENTS

| | | | | |
|---|---|---|---|---|
| 5,471,909 | A | 12/1995 | Kobelt | |
| 6,029,561 | A * | 2/2000 | Naslund et al. | 91/394 |
| 2009/0007771 | A1 * | 1/2009 | Matsumoto | 91/166 |
| 2010/0107572 | A1 * | 5/2010 | Slomp et al. | 53/559 |

FOREIGN PATENT DOCUMENTS

| | | | |
|---|---|---|---|
| DE | 29900850 | U1 | 4/1999 |
| DE | 102005038357 | A1 | 2/2007 |
| EP | 0837248 | A2 | 4/1998 |
| JP | 09303320 | A * | 11/1997 |
| JP | 9303320 | A | 11/1997 |

* cited by examiner

*Primary Examiner* — Thomas E Lazo
(74) *Attorney, Agent, or Firm* — The Ollila Law Group LLC

(57) ABSTRACT

A fluid operated actuator (100) is provided. The fluid operated actuator (100) includes a body (101) forming a piston bore (201). A piston (111) is movable within the piston bore (201). The fluid operated actuator (100) also includes a valve unit (105) coupled to the body (101) and including a fluid inlet port (217), a fluid exhaust port (220), and a valve member (214) configured to selectively open a fluid flow path between the fluid inlet port (217) and the piston bore (201) and between the exhaust port (220) and the piston bore (201). The fluid operated actuator (100) can also include a control unit (106) coupled to the body (101) and the valve unit (105). The control unit (106) can include a pilot input port (317*a*) in fluid communication with the fluid inlet port (217). The control unit (106) can also include first and second pilot output ports (317*b*, 317*c*) in fluid communication with the valve member (214). Further, the control unit (106) can include a pilot valve (230) adapted to open a fluid flow path between the pilot input port (317*a*) and one or more of the first and second pilot output ports (317*b*, 317*c*) in order to actuate the valve member (214).

15 Claims, 3 Drawing Sheets

FLUID OPERATED ACTUATOR

CROSS-REFERENCE TO RELATED APPLICATIONS

This is a National Stage entry of International Application No. PCT/EP2010/006614, with an international filing date of Oct. 29, 2010 which claims priority of U.S. provisional patent application No. 61/256,176, filed Oct. 29, 2009 entitled "FLUID OPERATED ACTUATOR".

TECHNICAL FIELD

The present invention relates to, fluid operated actuators, and more particularly, to a fluid operated actuator with various interchangeable components.

BACKGROUND OF THE INVENTION

Fluid operated actuators have received great success, in part, because of their wide range of applicability. One example of a fluid operated actuator is a piston positioned in a cylinder. The piston may be attached to a working carriage extending through a sealed portion of the cylinder that is attached to the piston. Another example comprises a rod attached to the piston and extending through one end of the cylinder. In both situations, fluid is introduced into a first side of the cylinder to move the piston in one direction while fluid on the second side of the piston is exhausted to the environment. To reverse directions of the piston, fluid is introduced on the second side of the piston and exhausted from the first side.

Due, in part, to the success of fluid operated actuators, there has been an attempt to increase the potential environments in which the actuators can be utilized. For example, there is a desire to utilize fluid operated actuators in sanitary environments, such as food and beverage factories; however, due to the external surfaces, the exterior of fluid operated actuators typically cannot be properly cleaned between or during use. Therefore, there has been an attempt to provide a fluid operated actuator with a generally smooth exterior surface. In other words, the exterior surface is generally free of sharp changes or protruding ribs or crevices that can collect fluid and bacteria. Prior art fluid operated actuators have been limited in how the various components are manufactured. This is because creating a smooth exterior surface has been problematic in the past when the fluid operated actuator is formed by a pressure die-cast process. This is because as is generally known in pressure die-cast processes, there is a desire to provide a substantially equal wall thickness throughout a particular part. However, due to the various internal configurations and passages, an equal wall thickness is difficult to obtain while providing a smooth exterior surface. Further, typical die-cast parts comprise a solid structure resulting in a relatively heavy and expensive component.

In addition, the fluid supply to/from the fluid operated actuator is typically controlled by a valve that is separate and sometimes remote from the fluid operated actuator. As a result, a series of complex external piping and electrical wiring is often required. The piping is typically required to provide a fluid communication path for actuating the fluid operated actuator. The wiring is typically required for various sensors that may be provided on the fluid operated actuator. Not only is the external piping and wiring expensive, but also it is difficult to keep properly cleaned. Therefore, there is a desire to provide a fluid operated actuator that includes an integrated valve that can be easily removed and replaced depending on the particular application. Further, there is a need to provide a pilot valve that can control the integrated valve without requiring excessive piping and electrical connections.

Another problem with prior art actuators is the requirement to provide an individual seal for each fluid passage that is provided in the fluid operated actuator. Each component may have various ports, which typically require individual seals. However, providing individual seals can become costly as the number of components provided in a fluid operated actuator increases. Therefore, there is a need to reduce the cost and complexity associated with providing a fluid tight fluid operated actuator.

The present invention overcomes these and other problems and an advance in the art is achieved. The present invention provides a fluid operated actuator with an integrated valve. The present invention provides an integrated pilot control and sensing module. Further, the present invention provides end caps that are formed using a die-cast process while comprising a smooth exterior surface. The present invention also provides a multiple lip seal that is capable of providing a fluid tight seal between various ports thereby reducing the total number of separate sealing members. The various features of the present invention may be combined in a single actuator or may be utilized individually in prior art actuators.

SUMMARY OF THE INVENTION

A fluid operated actuator is provided according to an embodiment of the invention. The fluid operated actuator can include a body forming a piston bore and a piston movable within the piston bore. According to an embodiment of the invention, the fluid operated actuator can include a valve unit coupled to the body. The valve unit can include a fluid inlet port, a fluid exhaust port, and a valve member configured to selectively open a fluid flow path between the fluid inlet port and the piston bore and between the exhaust port and the piston bore. According to an embodiment of the invention, the fluid operated actuator can also include a control unit coupled to the body and the valve unit. The control unit can include a pilot input port in fluid communication with the fluid inlet port. The control unit can also include first and second pilot output ports in fluid communication with the valve member. According to an embodiment of the invention, the control unit can also include a pilot valve adapted to open a fluid flow path between the pilot input port and one or more of the first and second pilot output ports in order to actuate the valve member.

A fluid operated actuator is provided according to another embodiment of the invention. According to an embodiment of the invention, the fluid operated actuator includes a body forming a piston bore and a piston movable within the piston bore. According to an embodiment of the invention, the fluid operated actuator includes first and second end caps coupled to the body. According to an embodiment of the invention, one or both of the first and second end caps comprise two or more die-cast portions.

A fluid operated actuator is provided according to an embodiment of the invention. The fluid operated actuator includes a body forming a piston bore and a piston movable within the piston bore. According to an embodiment of the invention, the fluid operated actuator also includes first and second end caps coupled to the body. According to an embodiment of the invention, the fluid operated actuator also includes one or more sealing members positioned between the body and an end cap, with each sealing member comprising two or more sealing lips.

Aspects

A fluid operated actuator comprises:

a body forming a piston bore;

a piston movable within the piston bore;

a valve unit coupled to the body and including a fluid inlet port, a fluid exhaust port, and a valve member configured to selectively open a fluid flow path between the fluid inlet port and the piston bore and between the exhaust port and the piston bore;

a control unit coupled to the body and the valve unit and including:

a pilot input port in fluid communication with the fluid inlet port;

first and second pilot output ports in fluid communication with the valve member; and a pilot valve adapted to open a fluid flow path between the pilot input port and one or more of the first and second pilot output ports in order to actuate the valve member.

Preferably, the control unit further comprises a controller in electrical communication with one or more sensors coupled to the body.

Preferably, the controller is configured to actuate the pilot valve based on a position of the piston in the piston bore.

Preferably, the controller further comprises one or more visual indicators.

Preferably, the control unit further comprises a first supply port in fluid communication with a first side of the piston and a second supply port in fluid communication with a second side of the piston.

Preferably, the fluid operated actuator further comprises a first end cap coupled to the valve unit and a second end cap coupled to the body.

Preferably, one or both of the first and second end caps comprise two or more portions coupled together, with each of the two or more portions comprising an internal cavity.

Preferably, one or both of the first and second end caps comprise die-cast end caps.

Preferably, the fluid operated actuator further comprises a sealing member positioned between the body and one of the first or second end caps, wherein the sealing member comprises two or more sealing lips to provide two or more substantially fluid tight seals between the body and one of the first or second end caps.

Preferably, the sealing member comprises:

a first sealing lip forming a substantially fluid tight seal between a protrusion extending from the end cap and the piston bore;

a second sealing lip forming a substantially fluid tight seal between a fluid channel formed in the body and a first end cap port formed in the second end cap; and a third sealing lip forming a substantially fluid tight seal between an outer surface of the body and an outer surface of the second end cap.

According to another aspect of the invention, a fluid operated actuator comprises:

a body forming a piston bore;

a piston movable within the piston bore; and first and second end caps coupled to the body;

wherein one or both of the first and second end caps comprise two or more die-cast portions.

Preferably, each of the two or more die-cast portions include internal cavities.

Preferably, each of the two or more die-cast portions comprise walls having substantially equal thicknesses.

According to another aspect of the invention, a fluid operated actuator comprises:

a body forming a piston bore;

a piston movable within the piston bore;

first and second end caps coupled to the body; and one or more sealing members positioned between the body and an end cap, with each sealing member comprising two or more sealing lips.

Preferably, a first sealing lip forms a substantially fluid tight seal between a protrusion extending from the second end cap and the piston bore.

Preferably, a second sealing lip forms a substantially fluid tight seal between a fluid channel formed in the body and a first end cap port formed in the second end cap.

Preferably, a third sealing lip forms a substantially fluid tight seal between an outer surface of the body and an outer surface of the second end cap.

DETAILED DESCRIPTION OF THE INVENTION

Figure 1:
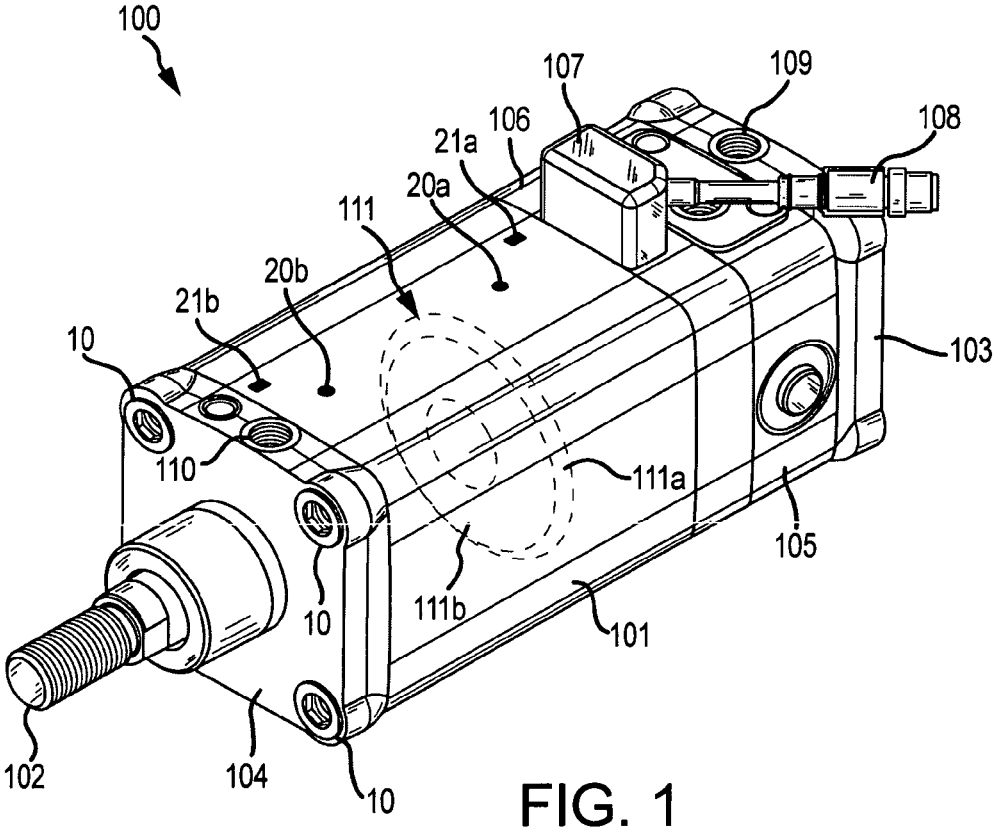
FIG. 1 shows a fluid operated actuator according to an embodiment of the invention.
Figure 2:
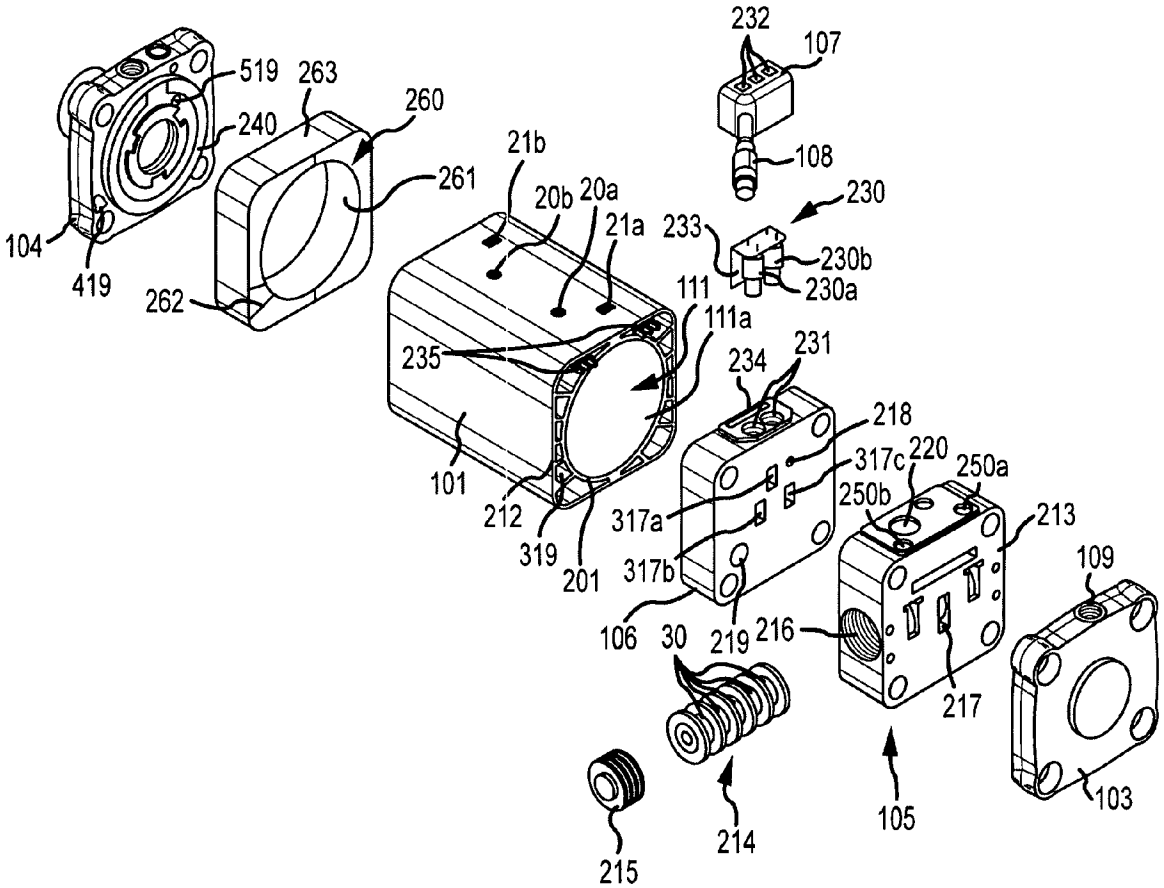
FIG. 2 shows an exploded view of the fluid operated actuator according to an embodiment of the invention.
Figure 3:
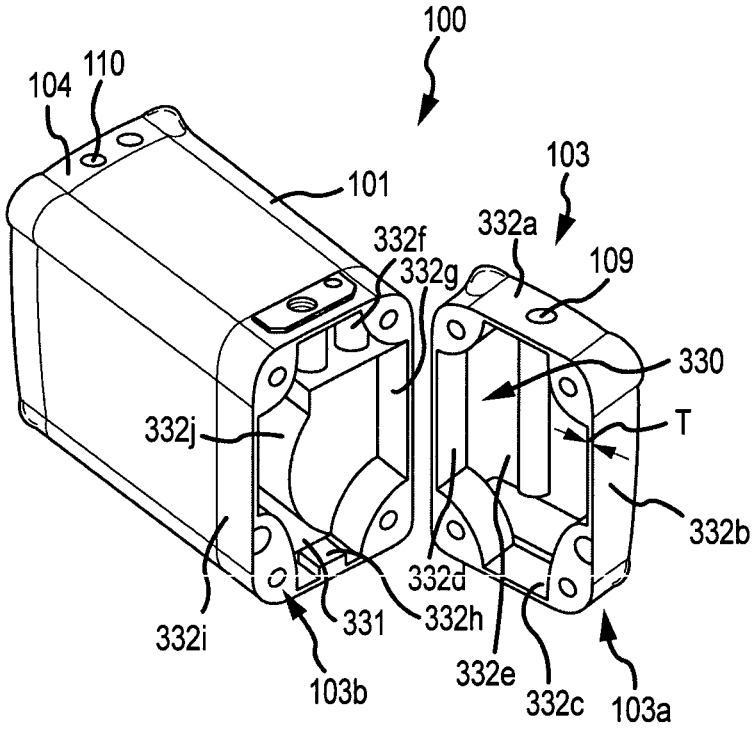
FIG. 3 shows the fluid operated actuator with an end cap separated into two portions according to an embodiment of the invention.

FIGS. 1-3 and the following description depict specific examples to teach those skilled in the art how to make and use the best mode of the invention. For the purpose of teaching inventive principles, some conventional aspects have been simplified or omitted. Those skilled in the art will appreciate variations from these examples that fall within the scope of the invention. Those skilled in the art will appreciate that the features described below can be combined in various ways to form multiple variations of the invention. As a result, the invention is not limited to the specific examples described below, but only by the claims and their equivalents.

FIG. 1 shows a fluid operated actuator 100 according to an embodiment of the invention. The fluid operated actuator 100 shown in FIG. 1 includes a body 101, a piston rod 102, a first end cap 103, a second end cap 104, a valve unit 105, and a control unit 106. According to an embodiment of the invention, the components of the fluid operated actuator 100 can be held together using adhesives, brazing, bonding, mechanical fasteners, etc. In the embodiment shown, mechanical fasteners 10 are used. According to some embodiments, the piston rod 102 may be replaced by a carriage (not shown), such as in a rodless cylinder design, for example. According to an embodiment of the invention, the end caps 103, 104, the valve unit 105, and the control unit 106 may comprise standard dimensions and fastening features such that they can be interchanged with similar components, i.e., "modular" components. Further, in some embodiments, the order of the units may vary. For example, in some embodiments, the control unit 106 may be positioned between the body 101 and the second end cap 104. In other embodiments, the valve unit 105 may be positioned between the body 101 and the control unit 106. Therefore, it should be appreciated that the particular configuration shown in the figures is merely one possible example.

It should be appreciated, that the piston rod 102 is typically coupled to a piston 111 that is movable within the body 101. The piston 111 is shown by dashed lines through the body 101 in FIG. 1. To aid in the understanding of the present invention, the piston 111 is described as comprising a first side 111*a* and a second side 111*b*. As can be appreciated, when fluid is supplied to the first side 111*a* of the piston 111, the piston 111 and thus, the piston rod 102 extend from the body 101 and the second end cap 104. Conversely, when fluid is supplied to the second side 111*b* of the piston 111, the piston 111 and thus, the piston rod 102 are retracted into the body 101. This orientation will be used throughout the specification. According to an embodiment of the invention, the fluid operated actuator 100 can be operated to actuate the piston and thus, the piston rod 102. A work piece (not shown) may be coupled to the piston rod 102 as is known in the art. According to one embodiment of the invention, fluid is supplied to a first side 111*a* of the piston 111 through a first port 109 formed in the first end cap 103 while fluid is supplied to a second side 111*b* of the piston 111 through a second port 110 formed in the second end cap 104. In such embodiments, the valve unit 105 may be omitted. According to another embodiment of the invention, fluid can be provided to both the first and second sides 111*a*, 111*b* of the piston 111 through the first end cap 103 as is described in more detail below. Therefore, while a second port 110 is shown in the figures, it should be appreciated that in some embodiments, the second port 110 formed in the second end cap 104 may be omitted. The actuation of the fluid operated actuator 100 is described in more detail below.

According to the embodiment shown, the control unit 106 can be adapted to receive a controller 107. The controller 107 may comprise an electronic controller, for example. The controller 107 can communicate with an external device such as a general-purpose computer, a microprocessor, or any other suitable processing system via a connector 108. The connector 108 may be adapted to communicate according to one or more communication protocols such as serial communication, parallel communication, fieldbus communication, etc. Other communication protocols are certainly possible and the protocols listed should in no way limit the scope of the present invention.

According to an embodiment of the invention, the control unit 106 can control the valve unit 105. According to an embodiment of the invention, the controller 107 can control the valve unit 105 based on signals received from position sensors 20*a*, 20*b*. Suitable position sensors such as the position sensors used in one embodiment of the invention are disclosed in U.S. Pat. No. 7,263,781, which is hereby incorporated by reference. The position sensors 20*a*, 20*b* may be coupled to the body 101, for example. In some embodiments, the position sensors 20*a*, 20*b* may extend through the body 101 into the piston bore 201 (See FIG. 2). The position sensors 20*a*, 20*b* may be provided to determine a position of the piston 111 as it moves within the body 101, for example. In some embodiments, the position sensors 20*a*, 20*b* may be able to determine when the piston 111 has reached a predetermined position sensor 20*a*, 20*b*. In other words, when the piston 111 is between the position sensors 20*a*, 20*b*, the precise position of the piston 111 may not be known. In other embodiments, the position sensors 20*a*, 20*b* may provide a substantially continuous position indication. The position sensors 20*a*, 20*b* may comprise magnetic position sensors, for example. However, other position sensors are known and the present invention should not be limited to magnetic position sensors. According to another embodiment of the invention, the body 101 may comprise one or more pressure sensors 21*a*, 21*b*, which may send pressure measurements to the controller 107. While only two pressure sensors 21*a*, 21*b* are shown, it should be appreciated that any number of pressure sensors 21*a*, 21*b* may be provided. Therefore, the controller 107 may control the valve unit 105 based on a signal received from the pressure sensors 21*a*, 21*b*. According to yet another embodiment of the invention, the controller 107 can control the valve unit 105 according to an input received through the connector 108, for example. The controller 107 may receive a signal to control the valve unit 105 from a user or operator, for example.

FIG. 2 shows an exploded view of the fluid operated actuator 100 according to an embodiment of the invention. The piston rod 102 has been omitted from the figure to simplify the drawing. However, the piston 111 is visible within the body 101. The piston 111 may comprise a sealing member 212 that is adapted to form a substantially fluid tight seal between the piston 111 and the piston bore 201 formed by the interior of the body 101. As can be appreciated, the piston 111 is movable within the piston bore 201. The piston 111 may be movable based on a differential pressure experienced between the first side 111*a* and the second side 111*b* of the piston 111, for example.

According to an embodiment of the invention, the control unit 106 is positioned between the valve unit 105 and the body 101. However, as discussed above, the control unit 106 does not have to be positioned between the valve unit 105 and the body 101. However, it is advantageous to have the control unit 106 in fluid communication with the valve unit 105 in order to reduce the required fluid piping. As shown in FIG. 2, the control unit 106 may comprise one or more ports 317*a*, 317*b*, 317*c*, 218, and 219. According to an embodiment of the invention, the control unit 106 comprises the controller 107 as described above as well as a pilot valve 230. According to an embodiment of the invention, the control unit 106 may also comprise one or more electrical contacts 233 and an electrical contact receiver 234. According to an embodiment of the invention, the electrical contact 233 may comprise a printed circuit board (PCB) as shown, or may comprise some other electrical communication medium, such as electrical leads, for example. Therefore, the present invention should not be limited to requiring a PCB. The electrical contact 233 may provide an electrical communication medium between the controller 107 and the pilot valve 230. According to another embodiment of the invention, the electrical contact 233 may also provide an electrical communication medium between the controller 107 and the various sensors 20*a*, 20*b*, and 21*a*, 21*b* coupled to the body 101. According to an embodiment of the invention, electrical contacts 235 may be provided that extend from the body 101. The electrical contacts 235 can engage the electrical contact 233 provided in the control unit 106, for example. The electrical contacts 235 may provide electrical communication between the sensors 20*a*, 20*b*, 21*a*, 21*b*, and the control unit 106, for example.

The control unit 106 may provide a plurality of functions. According to an embodiment of the invention, the control unit 106 may be provided to communicate various operating conditions to an external processing system (not shown). For example, the control unit 106 may communicate the position of the piston 111 and/or pressure in the piston bore 201 to an external processing system. The external processing system may comprise a general-purpose computer, a microprocessor, or any other suitable processing system. The particular external processing system used may depend on the particular implementation of the fluid operated actuator 100 and therefore should in no way limit the scope of the present invention.

According to an embodiment of the invention, the pilot valve 230 can comprise one or more solenoid valves 230*a*, 230*b*. At least a portion of the pilot valve 230 can be received in a pilot valve receiver 231 formed in the control unit 106. As discussed above, the controller 107, which is in communication with the pilot valve 230 can control the valve unit 105. More specifically, according to an embodiment of the invention, the pilot valve 230 can control the valve unit 105 by controlling a pilot pressure used to actuate the valve unit 105. According to an embodiment of the invention, the pilot valve 230 can selectively open a fluid communication path between the pilot input port 317*a* and one or more of the first or second pilot output ports 317*b*, 317*c* formed in the control unit 106. According to an embodiment of the invention, the control unit 106 may comprise a fluid path formed within the interior of the control unit 106 that communicates with the pilot input port 317*a*, the pilot valve receiver 231, and the pilot output ports 317*b*, 317*c*. As described in more detail below, in some embodiments, the pilot pressure controlled by the pilot valve 230 may be provided from the same inlet pressure that actuates the piston 111.

According to an embodiment of the invention, the valve unit 105 comprises a valve housing 213 and a movable valve member 214. The valve member 214 may be received in the valve housing 213 through an aperture 216 formed in the valve housing 213. While the valve member 214 is shown as comprising a spool valve, it should be appreciated that other types of valves may be used. In embodiments using a spool valve, the valve member 214 may comprise a spool 214 including a plurality of grooves or recesses 30. When properly aligned, the recesses 30 can open a fluid flow path (not shown) within the valve housing 214. Operation of spool valves is generally known in the art and therefore, a detailed discussion is omitted for brevity of the description. In addition, the valve unit 105 can include a valve seal 215. According to an embodiment of the invention, the valve seal 215 can be provided to retain the valve member 214 within the valve housing 213. The valve seal 215 can also prevent fluid from escaping through the aperture 216 formed in the valve housing 213 that is adapted to receive the valve member 214.

According to an embodiment of the invention, the valve housing 213 includes a fluid inlet port 217. When the valve unit 105 is coupled to the end cap 103, the fluid inlet port 217 can be in fluid communication with the first fluid port 109 formed in the first end cap 103. The first fluid port 109 may be in communication with a pressurized fluid source (not shown). In other embodiments, the first fluid port 109 may be omitted and the pressurized fluid supply may be connected directly to the valve unit 105. In addition, the valve housing 213 can include a plurality of fluid ports (not shown) that align with and communicate with the plurality of corresponding fluid ports 317*a*, 317*b*, 317*c*, 218, 219 formed in the control unit 106. According to an embodiment of the invention, the valve housing 213 can include a plurality of internally formed fluid channels (not shown). The internally formed fluid channels can selectively provide a fluid communication path between either the fluid inlet port 217 or the exhaust port 220 and the fluid ports formed in the valve housing 213 discussed above that correspond to the fluid ports formed in the control unit 106. The position of the valve member 214 can determine whether the ports communicate with the fluid inlet port 217 or the exhaust port 220.

According to an embodiment of the invention, the valve member 214 may be biased to a de-actuated position by one or more biasing members (not shown), for example. According to another embodiment of the invention, the valve member 214 may be biased in the de-actuated position using fluid pressure controlled by the pilot valve 230. According to an embodiment of the invention, in the de-actuated position, the valve member 214 may open a fluid flow path between the fluid inlet 217 and a pilot inlet port 317*a* formed in the control unit 106. According to an embodiment of the invention, when the valve member 214 is in the de-actuated position, the first and second supply ports 218, 219 may be closed off from both the fluid inlet 217 and the fluid exhaust 220. As a result, the piston 111 is not actuated. Alternatively, when the valve member 214 is biased to a de-actuated position, fluid pressure may be supplied to both sides 111*a* and 111*b* of the piston 111.

As discussed briefly above, according to an embodiment of the invention, the controller 107 can control the pilot valve 230. According to an embodiment of the invention, when the pilot valve 230 is in a de-actuated position, fluid communication is closed between the pilot input port 317*a* and the pilot output ports 317*b*, 317*c*. According to another embodiment of the invention, when the pilot valve 230 is in a de-actuated position, a fluid communication path may be opened between the pilot input port 317*a* and both of the pilot output ports 317*b*, 317*c*. In this embodiment, pilot pressure can be supplied to both sides of the valve member 214 when the pilot valve 230 is de-actuated. According to an embodiment of the invention, when the pilot valve 230 is in a first actuated position, a first one of the solenoid valves 230*a* of the pilot valve 230 is actuated, thereby opening a fluid flow path between the pilot input port 317*a* and the first pilot output port 317*b* while the fluid flow path between the pilot input port 317*a* and the second pilot output 317*c* is closed. When the pilot valve 230 is in the first actuated position, fluid from the first pilot output port 317*b* is supplied to a first side of the valve member 214, which actuates the valve member 214 to a first actuated position. With the valve member 214 actuated to a first actuated position, the valve member 214 opens a fluid flow path from the fluid inlet port 217, formed in the valve housing 213, to the first supply port 218 formed in the control unit 106. As mentioned above, the valve unit 105 comprises ports that correspond to the ports shown formed in the control unit 106. According to an embodiment of the invention, the first supply port 218 comprises an aperture that extends completely through the control unit 106. Therefore, the fluid can flow through the first supply port 218 to the first side 111*a* of the piston 111. As described above, it should be appreciated that the valve housing 213 includes ports (not shown) that are aligned with the first and second supply ports 218, 219 formed in the control unit when the control unit 106 is coupled to the valve housing 213. As a result, when the valve member 214 is in the first actuated position, the piston 111 is actuated in a first direction, which extends the piston rod 102 from the body 101 in the configuration shown.

In addition to opening a fluid flow path from the inlet 109 to the first side 111*a* of the piston 111, when the valve member 214 is in the first actuated position, a fluid flow path is opened between the second supply port 219 formed in the control unit 106 and the exhaust 220 formed in the valve housing 213. According to an embodiment of the invention, the second supply port 219 is also in fluid communication with a fluid channel 319 formed in the body 101. With the fluid channel 319 formed in the body 101, external piping can be avoided. However, it should be appreciated that the fluid channel 319 may be omitted and external fluid piping could be provided as in the prior art. The fluid channel 319 can be in fluid communication with a first end cap port 419 formed in the second end cap 104. The second end cap 104 can also include an internal channel (not shown) that provides fluid communication between the first end cap port 419 and a second end cap port 519 formed in the end cap 104. According to an embodiment of the invention, the second supply port 519 can be formed in a protrusion 240 that extends from the second end cap 104. When the second end cap 104 is coupled to the body 101, the protrusion 240 can extend into the piston bore 201. As a result, in some embodiments, the second supply port 519 is in fluid communication with the second side 111 b of the piston 111. As a result, when the valve member 214 is in the first actuated position, fluid in the piston bore 201 that is exposed to the second side 111*b* of the piston 111 can exhaust from the fluid operated actuator 100 through the ports 519, 419, channel 319, port 219 and exhaust port 220. This fluid flow path prevents fluid pressure from building on the second side 111*a* of the piston 111 as the piston 111 is actuated in the first direction.

According to an embodiment of the invention, the piston 111 will be actuated in the first direction until the pilot valve 230 is actuated away from the first actuated position. According to an embodiment of the invention, the pilot valve 230 may remain in the first actuated position until the controller 107 sends a signal to the pilot valve 230. The controller 107 may change the pilot valve 230 based on a signal received from position sensor 20*b*, for example. According to an embodiment of the invention, the pilot valve 230 may be actuated to close the exhaust 230, with the fluid inlet port 217 remaining in fluid communication with the first side 111 a of the piston. As a result, pressure exposed to the second side 111*b* of the piston 111 will increase to partially counter the pressure acting on the first side 111 a of the piston and cushion the end stroke of the piston 111. According to an embodiment of the invention, when the controller 107 receives a signal from the second position sensor 20*b*, the controller 107 can actuate the pilot valve 230 to a second actuated position to retract the piston 111. In order to retract the piston 111 and piston rod 102 (move the piston 111 in the second direction), the pilot valve 230 can be actuated to a second actuated position.

According to an embodiment of the invention, when the pilot valve 230 is in the second actuated position, the second solenoid valve 230*b* can be actuated and the first solenoid valve 230*a* can be de-actuated. As a result, the fluid flow path between the pilot input port 317*a* and the first pilot output port 317*b* is closed and a fluid flow path between the pilot input port 317*a* and the second pilot output port 317*c* is opened. As a result, a pilot pressure is provided to a second side of the valve member 214 to actuate the valve member 214 to a second actuated position. It should be appreciated that in other embodiments where the valve member 214 does not comprise a spool valve, the output pressure from the pilot valve 230 may not act on a specific side of the valve, but can still actuate the valve to various positions as is known in the art.

According to an embodiment of the invention, when the valve member 214 is in the second actuated position, a fluid flow path is opened between the fluid inlet port 217 and the second supply port 219 formed in the control unit 106. As a result, pressurized fluid can be provided to the second side 111*b* of the piston 111 through the fluid pathway described above. Conversely, when the valve member 214 is in the second actuated position, a fluid flow path is opened between the first supply port 218 formed in the control unit 106 and the exhaust port 220. As a result, pressurized fluid previously acting on the first side 111 a of the piston 111 can be exhausted as the piston 111 and piston rod 102 are retracted into the body 101.

According to an embodiment of the invention, the piston 111 may be actuated in the second direction until the controller 107 receives a signal from the first position sensor 20*a*. According to an embodiment of the invention, when the controller 107 receives a signal from the position sensor 20*a*, the controller 107 may de-actuate the pilot valve 230. De-actuating the pilot valve 230 may close all of the fluid flow paths to/from the first and second supply ports 218, 219, for example. According to another embodiment of the invention, when the controller 107 receives a signal from the first position sensor 20*a*, the controller 107 may actuate the pilot valve 230 to the first actuated position in order to once again extend the piston 111 and the piston rod 102. According to another embodiment of the invention, the supply port 218 may be closed off from the exhaust 220 to provide a cushion as described above when actuating the piston 111 and piston rod 102 in the first direction. As can be appreciated, the fluid inlet port 217 remains in fluid communication with the pilot valve 230, and more specifically, the pilot input port 317*a* regardless of the position of the valve member 214.

According to an embodiment of the invention, the controller 107 may include one or more visual indicators 232. The one or more visual indicators 232 may comprise LEDs, fluorescent lamps, incandescent lamps, etc. The one or more visual indicators 232 may also comprise a user interface display. According to an embodiment of the invention, the visual indicators 232 can provide a visual indication of the position of the piston, the present actuation of the pilot valve, pressure in the piston bore, etc. It should be appreciated that the control unit 106 can advantageously comprise an integrated control for the fluid operated actuator 100. With the control unit 106 coupled to the body 101 and the valve unit 105, and positioned between the body 101 and valve unit 105, the wiring required to control the fluid operated actuator 100 is substantially reduced. Further, the required fluid conduits are substantially reduced. One reason for the reduction in fluid conduits is due to the fluid interface of the control unit 106 that comprises the plurality of ports 218, 219, 317*a*, 317*b*, 317*c*. In addition, the number of fluid conduits can be reduced because the control unit 106 utilizes the supply pressure for the piston 111 for the pilot valve 230. Advantageously, a separate pilot pressure supply is not required. This internal air supply system significantly reduces the required flow path.

Because the same pressure supply is utilized for the pilot pressure as well as the operating pressure, according to an embodiment of the invention, the valve unit 105 can comprise pressure adjustment members 250*a*, 250*b*. The pressure adjustment members 250*a*, 250*b* may comprise needle shaped pins that can be inserted into the internally formed channels to adjust the size of the fluid channels formed in the valve housing 213 that communicate with the fluid inlet port 217 and the exhaust 220, for example. As a result, the delivered pressure can be controlled independent of the supply pressure provided to port 109.

In addition to the advantages of the fluid operated actuator 100 described above, the fluid operated actuator 100 includes other advantages that can reduce the cost of the fluid operated actuator 100 as well as reduce the assembly time.

As shown in FIG. 2, a sealing member 260 is provided according to an embodiment of the invention. While only one sealing member 260 is shown in FIG. 2 for simplicity, it should be appreciated that similar sealing members 260 may be provided between each of the components shown. According to an embodiment of the invention, the sealing member 260 can include multiple sealing lips (or rims) 261-263. The sealing member 260 can seal two or more components. As an example, the seal 260 is shown as providing a seal between the second end cap 104 and the body 101. In addition, the sealing member 260 provides a seal between two or more ports or apertures of the two or more components. For example, the sealing member 260 provides a substantially fluid tight seal between the channel 319 and the port 419 to form a fluid tight passage as well as between the protrusion 240 and the piston bore 201. Advantageously, a single sealing member 260 can replace multiple seals that are required by prior art systems. According to the embodiment shown, the sealing member 260 comprises a first sealing lip 261, a second sealing lip 262, and a third sealing lip 263. According to the embodiment shown, the first sealing lip 261 provides a substantially fluid tight seal between the piston bore 201 and the protrusion 240 extending from the end cap 104. According to an embodiment of the invention, the second sealing lip 262 provides a substantially fluid tight seal between the fluid channel 319 formed in the body 101 and the first end cap port 419 formed in the second end cap 104. According to an embodiment of the invention, the third sealing lip 263 provides a substantially fluid tight seal between the outer perimeter of the body 101 and the outer perimeter of the end cap 104. As a result, the third sealing lip 263 can substantially prevent fluid or other foreign matter, such as bacteria from entering between the interface of the end cap 104 and the body 101. It should be appreciated that the particular interfaces described above that the plurality of sealing lips 261-263 form a fluid tight seal with are merely examples and should not limit the scope of the invention. Rather, the plurality of sealing lips 261-263 may be configured to form a fluid tight seal between a variety of interfaces.

FIG. 3 shows a fluid operated actuator 100 according to another embodiment of the invention. Some of the components of the fluid operated actuator 100 have been omitted to simplify the drawing. According to an embodiment of the invention, one or both of the end caps 103, 104 can comprise die-cast components. More specifically, in some embodiments, the first and second end caps 103, 104 may comprise pressure die-cast components. It is generally known in the art that in order to obtain a suitable end cap, it is desirable for the end caps to comprise a substantially equal wall thickness throughout the end cap. However, because of the internal configuration of the end cap, prior art methods did not allow a continuously smooth exterior surface while maintaining an equal wall thickness. As a result, prior art fluid operated actuators were difficult to clean. By a continuously smooth exterior surface, it is meant that the exterior surface is generally free from sharp changes or sharp grooves or projections.

In the embodiment shown in FIG. 3, the first end cap 103 has been separated into two portions 103*a*, 103*b*. According to an embodiment of the invention, the two or more portions 103*a*, 103*b* comprise die-cast portions, which are formed from a die-cast process. The two or more separate end cap portions can be coupled together to form a single end cap 103. According to an embodiment of the invention, the two or more separate end cap portions are formed using a die-cast process. According to an embodiment of the invention, the two or more separate end cap components are formed using a pressure die-cast process as is generally known in the art. By forming an end cap from two separate components, the end cap can comprise a substantially equal wall thickness throughout the end cap.

As can be seen, each of the end cap portions 103*a*, 103*b* comprise an internal cavity 330, 331. The internal cavities 330, 331 allow substantially all of the walls 332*a-j* to comprise a substantially equal thickness T. It is generally known in die-casting that equal wall thickness is generally desirable. While there are many reasons for providing a die-cast part having an equal wall thickness, one reason is that during the molding process, the die-cast part cools move evenly if the wall thickness is substantially equal throughout the part. Another reason is that during use, the die-cast part will expand and shrink substantially equally when subjected to temperature variations if the walls are substantially equal. The above are merely examples to illustrate the desire to provide substantially equal wall thicknesses in a die-cast part.

The present invention provides a fluid operated actuator that is designed to substantially reduce the required fluid piping and electrical cabling. According to one embodiment of the invention, the fluid operated actuator advantageously couples a control unit 106 to the body 101. The control unit 106 can be in fluid communication with both the valve unit 105 as well as the body 101. Further, the control unit 106 can be in electrical communication with various sensors 20*a*, 20*b*, 21*a*, 21*b* coupled to the body. Advantageously, the control unit 106 can actuate the valve member 214 based on one or more signals received from one or more of the sensors. The control unit 106 can also provide a fluid interface between the valve unit 105 and the piston bore 201. Advantageously, a separate pilot fluid supply is not required as in the prior art designs, which position the pilot valve remote from the body 101 and the valve unit 105.

According to another embodiment of the invention, the present invention provides a sealing member 260 with two or more sealing lips 261-263. Advantageously, a single sealing member 260 can provide a fluid tight seal between two or more apertures or interfaces. As a result, the total number of separate sealing members can be substantially reduced.

According to another embodiment of the invention, the present invention provides one or more end caps 103, 104 that include die-cast portions 103*a*, 103*b*. The die-cast portion 103*a*, 103*b* are formed from a die-cast process as is generally known in the art. The die-cast portions 103*a*, 103*b* can include internal cavities 330, 331. The internal cavities 330, 331 can reduce the total material required to form the die-cast portions 103*a*, 103*b* as well as allow for a substantially equal wall thickness for the walls 332*a*-332*i*.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein can be applied to other fluid operated actuators, and not just to the embodiments described above and shown in the accompanying figures. Accordingly, the scope of the invention should be determined from the following claims.

We claim:

1. A fluid operated actuator (100), comprising:

a body (101) forming a piston bore (201);

a piston (111) movable within the piston bore (201);

a valve unit (105) coupled to the body (101) and including a fluid inlet port (217), a fluid exhaust port (220), and a valve member (214) configured to selectively open a fluid flow path between the fluid inlet port (217) and the piston bore (201) and between the exhaust port (220) and the piston bore (201);

a control unit (106) coupled to the body (101) and the valve unit (105) and including:

a pilot input port (317*a*) in fluid communication with the fluid inlet port (217);

first and second pilot output ports (317*b*, 317*c*) in fluid communication with the valve member (214); and a pilot valve (230) adapted to open a fluid flow path between the pilot input port (317*a*) and one or more of the first and second pilot output ports (317*b*, 317*c*) in order to actuate the valve member (214).

2. The fluid operated actuator (100) of claim 1, wherein the control unit (106) further comprises a controller (107) in electrical communication with one or more sensors (20*a*, 20*b*, 21*a*, 21*b*) coupled to the body (101).

3. The fluid operated actuator (100) of claim 2, wherein the controller (107) is configured to actuate the pilot valve (230) based on a position of the piston (111) in the piston bore (201).

4. The fluid operated actuator (100) of claim 2, wherein the controller (107) further comprises one or more visual indicators (232).

5. The fluid operated actuator (100) of claim 1, wherein the control unit (106) further comprises a first supply port (218) in fluid communication with a first side (111*a*) of the piston (111) and a second supply port (219) in fluid communication with a second side (111*b*) of the piston (111).

6. The fluid operated actuator (100) of claim 1, further comprising a first end cap (103) coupled to the valve unit (105) and a second end cap (104) coupled to the body (101).

7. The fluid operated actuator (100) of claim 6, wherein one or both of the first and second end caps (103, 104) comprise two or more portions (103*a*, 103*b*) coupled together, with each of the two or more portions (103*a*, 103*b*) comprising an internal cavity (330, 331).

8. The fluid operated actuator (100) of claim 7, wherein one or both of the first and second end caps (103, 104) comprise die-cast end caps.

9. The fluid operated actuator (100) of claim 6, further comprising a sealing member (260) positioned between the body (101) and one of the first or second end caps (103, 104), wherein the sealing member (260) comprises two or more sealing lips (261, 262, 263) to provide two or more substantially fluid tight seals between the body (101) and one of the first or second end caps (103, 104).

10. The fluid operated actuator (100) of claim 9, wherein the sealing member (260) comprises:

a first sealing lip (261) forming a substantially fluid tight seal between a protrusion (240) extending from the end cap (104) and the piston bore (201);

a second sealing lip (262) forming a substantially fluid tight seal between a fluid channel (319) formed in the body (101) and a first end cap port (419) formed in the second end cap (104); and a third sealing lip (263) forming a substantially fluid tight seal between an outer surface of the body (101) and an outer surface of the second end cap (104).

11. A fluid operated actuator (100), comprising:

a body (101) forming a piston bore (201);

a piston (111) movable within the piston bore (201); and first and second end caps (103, 104) coupled to the body (101);

wherein one or both of the first and second end caps (103, 104) comprise two or more die-cast portions (103*a*, 103*b*), and wherein each of the two or more die-cast portions (103*a*, 103*b*) comprise walls (332*a*-332*i*) having substantially equal thicknesses.

12. The fluid operated actuator (100) of claim 11, wherein each of the two or more die-cast portions (103*a*, 103*b*) include internal cavities (330, 331).

13. A fluid operated actuator (100), comprising:

a body (101) forming a piston bore (201);

a piston (111) movable within the piston bore (201);

first and second end caps (103, 104) coupled to the body (101); and one or more sealing members (260) positioned between the body (101) and an end cap (103, 104), with each sealing member (260) comprising two or more sealing lips (261-263) , wherein a first sealing lip (261) forms a substantially fluid tight seal between a protrusion (240) extending from the second end cap (104) and the piston bore (201).

14. The fluid operated actuator (100) of claim 13, wherein a second sealing lip (262) forms a substantially fluid tight seal between a fluid channel (319) formed in the body (101) and a first end cap port (419) formed in the second end cap (104).

15. The fluid operated actuator (100) of claim 13, wherein a third sealing lip (263) forms a substantially fluid tight seal between an outer surface of the body (101) and an outer surface of the second end cap (104).

* * * * *